US006289701B1

(12) United States Patent
Hasenack

(10) Patent No.: US 6,289,701 B1
(45) Date of Patent: Sep. 18, 2001

(54) HOSIERY AND METHOD OF MAKING SAME

(75) Inventor: Klaus Hasenack, Wuppertal (DE)

(73) Assignee: 'WGF' Colcoton-Garn Hasenack & Co., Wuppertal (DE)

( * ) Notice: Subject to any disclaimer, the term of this patent is extended or adjusted under 35 U.S.C. 154(b) by 0 days.

(21) Appl. No.: 09/594,132

(22) Filed: Jun. 14, 2000

(30) Foreign Application Priority Data

Jun. 15, 1999 (EP) ..... 99111567

(51) Int. Cl.[7] ..... D04B 9/00
(52) U.S. Cl. ..... 66/202; 66/171
(58) Field of Search ..... 66/172 E, 171, 66/178 R, 178 A, 202; 57/210, 225

(56) References Cited

U.S. PATENT DOCUMENTS 4,470,250 * 9/1984 Arenz et al. ..... 57/225
4,509,320 * 4/1985 Maeda ..... 57/225
4,525,992 * 7/1985 Payen ..... 57/18
5,749,212 * 5/1998 Rees et al. ..... 57/225
5,823,014 * 10/1998 Kobayashi et al. ..... 66/178 R

FOREIGN PATENT DOCUMENTS 446 215 4/1964 (CH) .
298 22 860 4/1999 (DE) .
989 861 6/1949 (FR) .
1 205 967 4/1958 (FR) .

* cited by examiner

*Primary Examiner*—Danny Worrell
(74) *Attorney, Agent, or Firm*—Herbert Dubno

(57) ABSTRACT

Hosiery articles like stockings, hose, socks or the like are made from a false twist or spinning twist knitting yarn composed of cotton and/or wool and/or synthetic in which an elastomer is incorporated by the SpiroSpun process. The knitting yarn is made by the SpiroSpun process and is knitted into the garment shape without any other yarn.

10 Claims, 1 Drawing Sheet

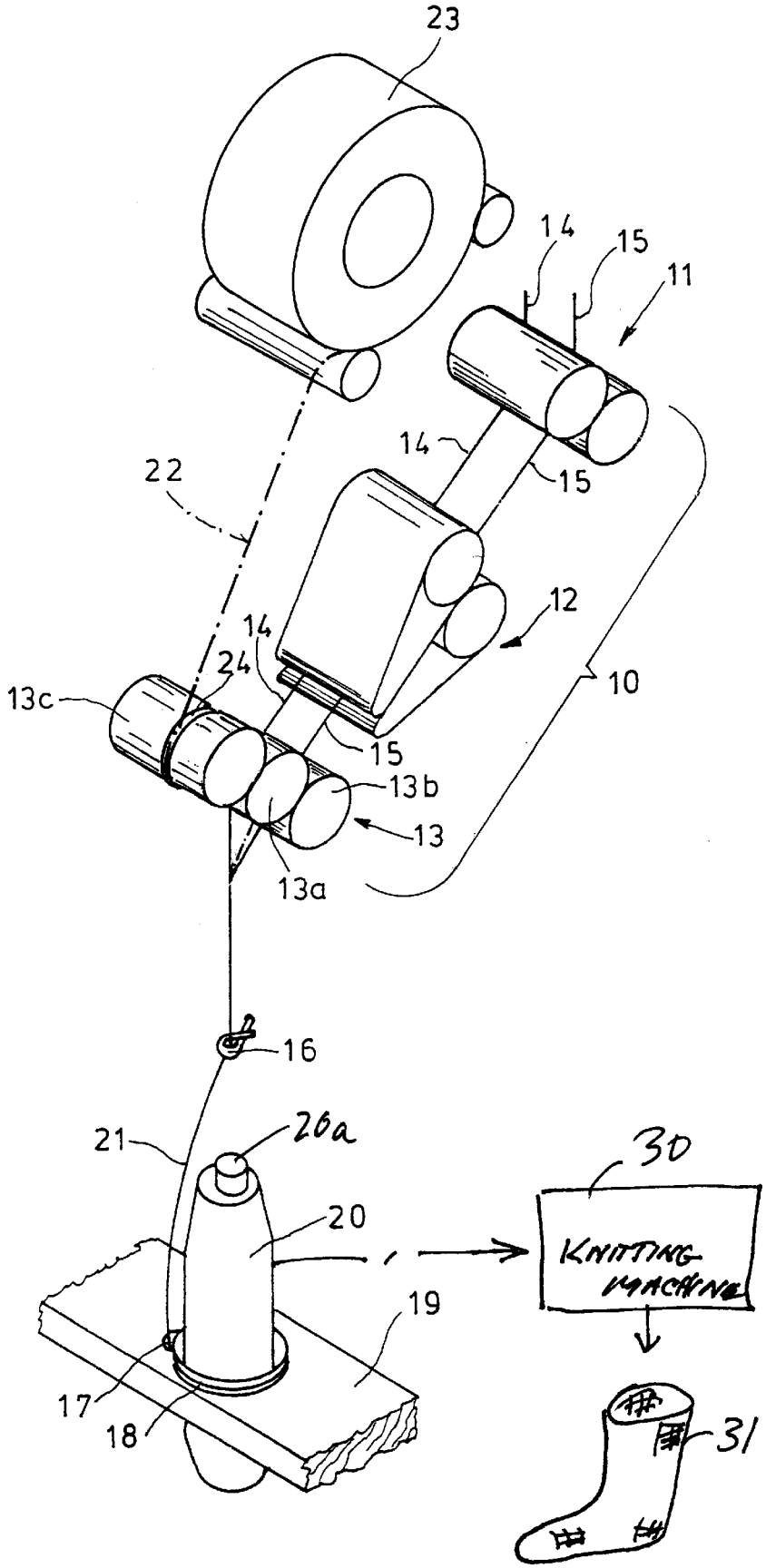
23
14
15
11
14
15
22
12
14
24
10
13c
15
13b
13
13a
16
21
26a
30
20
KNITTING MACHINE
19
17
18
31

HOSIERY AND METHOD OF MAKING SAME

FIELD OF THE INVENTION

My present invention relates to the production of elastic garments adapted to fit closely on a human body part, especially hosiery such as hose, stockings, and socks and the like. The invention also relates to a method of making such garments and, especially, stockings, socks and other hosiery articles which are to be sufficiently elastic as to hug the portion of the leg onto which the garment is fitted.

BACKGROUND OF THE INVENTION

As a practical matter in the past it has been the practice to produce knitted elastic garments such as hosiery from two or more yarns. In other words it was not as a rule possible to knit hosiery from a single yarn. In the knitting of hosiery, therefore, it was common to utilize a yarn which was spun from cotton and/or wool together with a second yarn which had the function of contributing to the hosiery the highest possible degree of elasticity. This is important in the case of stockings since the feet and legs of potential wearers can be greatly different in shape and dimensions. A knitting machine is, however, limited in the dimensions with which the tubular articles are to be knitted. The elastic yarn incorporated in the hosiery, therefore, must assume the function of allowing the garment to accommodate itself to the foot not only at the heel but also at the toe and to the leg all without the formation of folds.

To achieve this, knitted hosiery technology has developed a variety of techniques. Initially textured polyamide was used as a so-called plated yarn to contribute elasticity to the knitted goods. Subsequently elastomers (for example Lycra) entered the market in a significant way and the elastic yarns were so-called wrapped yarns and colored core yarns. The elastomer thread, for example (Lycra) could be wrapped with polyamide or could have cotton thread spun around the elastic core.

In spite of these developments, to date the hosiery structure has not changed materially. Now as then, two yarns are knitted together when the hosiery article is to be elastic. The plating technique has required the knitting yarn and the plating yarn always to maintain desired positions relative to one another. Usually the plating yarn (textured polyamide, wrapped yarn or core yarn) was provided on the inner side of the stocking while the outer side of the stocking was formed by cotton yarn, wool yarn or a blend thereof. The plating technique, however, has created two significant problems for the hosiery knitter.

(a) The two yarns must always be colored exactly the same. In practice this is not possible since no yarn supplier has all of the yarns which may be used for stocking manufacture in its program. Different substrates dye differently. Color deviations between the plating yarn and the knitting yarn are therefore frequently unavoidable.

(b) The plating technique has a defect frequency of 2 to 5% depending upon the nature of the knitting operation and the productivity of the enterprise. This means that 2 to 5% of the stockings have the yarn for the front and back sides interchanged. Since the colors do not match precisely, this means that the stockings will have stripes where the yarns have been reversed in position so that the stockings can only be marketed as second quality goods or cannot be sold at all.

These problems have plagued the industry even prior to the beginning of 1960 when French patent 1,205,976 was published describing the production of socks and men's hosiery by combining a nonelastic and elastic fiber intimately in a spun yarn. The latter yarn, however, had a very high elongatability and was not fully satisfactory as excessive elongatability is also a disadvantage since it is important to provide in such hosiery a certain restoring force upon elastic deformation to ensure a perfect conformity of the hosiery to the foot and leg. The yarn must have excellent appearance when knitted into the article and a pleasing soft hand in the fabric. These features were not characteristic of the earlier yarns.

OBJECTS OF THE INVENTION

It is the principal object of the present invention to provide a method of making hosiery which avoids the plating technique and significantly simplifies the process, especially for stockings, socks and hose.

Another object of the invention is to eliminate disadvantages of earlier elastic garments and their fabrication.

SUMMARY OF THE INVENTION

These objects and others which will become apparent hereinafter are attained, in accordance with the invention by the use of false twist or spinning twist knitting yarn made by combining a first yarn selected from the group which consists of cotton yarn, wool yarn, a synthetic yarn and blends thereof with a second yarn different from the first yarn and including an elastomer, and spinning the combined first and second yarns in a SpiroSpun process, for producing an elastic garment in the form of hose, a stocking or a sock.

More particularly, the method of the invention can comprise the steps of:

(a) forming a knitting yarn by combining a first yarn selected from the group which consists of cotton yarn, wool yarn, a synthetic yarn and blends thereof with a second yarn different from the first yarn and including an elastomer, and spinning the combined first and second yarns in a SpiroSpun process with a false twist or spinning twist; and (b) knitting said knitting yarn into an elastic garment shaped to conform to a human body part to be received therein.

The elastic garment, namely, socks, stockings, panty hose and like hosiery, is shaped to fit the human body part and is knitted from a knitting yarn formed by combining a first yarn selected from the group which consists of cotton yarn, wool yarn, a synthetic yarn and blends thereof with a second yarn different from the first yarn and including an elastomer, and spinning the combined first and second yarns in a SiroSpun process with a false twist or spinning twist.

The invention, therefore, allows the production of stockings, hose, socks and like garments from a knitting yarn which has been used as a yarn in weaving technology and which is made by the SiroSpun process, (a spin-twisting process involving the doubling of yarn) from wool and/or cotton with an elastomer filament (of the type which is known from the production of wrapped yarn or core yarn) and can be the filament core thereof, (for example Lycra) to form a false or mock twist or a spinning twist. The knitting yarn which is made in this manner can have a denier or gauge common for such hosiery. The SiroSpun process is described, inter alia in Lexikon fur Textilveredlung, Vol. 3, Page 1989–1990, Laumann-Verlag, Dülmen, 1995.

Hitherto so-called SiroSpun were exclusively used in weaving operations. There they served as an inexpensive variant to twisted weaving yarns. In the weaving industry, there is direct differentiation between the yarns used for the warp and weft and there the reject problem associated with the plating technique does not arise.

A significant advantage of the invention is that it allows the production of elastic stockings and comparable garments by knitting without the need for two yarns. Only a single yarn is required. As a consequence, the problems of the plating technique are eliminated here as well as along all of the drawbacks associated therewith. It has been found, surprisingly, that the garments made in accordance with the present invention in their final manifestations have an aesthetically pleasing uniform mesh structure. In addition, the goods have an extremely soft hand.

According to the invention, the elastomer can be an elastomer filament or an elastomer filament core and the core can be the core of a core yarn and wrapped with an elastomer filament spun around that core.

BRIEF DESCRIPTION OF THE DRAWING

The above and other objects, features, and advantages will become more readily apparent from the following description, reference being made to the accompanying drawing, the sole FIGURE of which is a perspective view of the making of the knitting yarns, showing the use thereof diagrammatically.

SPECIFIC DESCRIPTION

The drawing shows at 10 the drafting system of a spinning station of the ring-spinning machine. The drafting frame 10 comprises a first or rearmost roller pair 11, a second or intermediate roller pair with belts 12 and a thread or front roller pair 13.

The drafting frame 10 with its roller pairs 11, 12, and 13 serves to draft two rovings or slivers 14, 15. Both rovings can be composed of wool fibers and/or cotton fibers and/or synthetic or combinations thereof.

The intermediate roller pair 12 runs with a somewhat higher peripheral speed than the rear roller pair 11 to slightly stretch the sliver fibers. Between the front roller pair 13 and the intermediate roller pair 12 because of the substantially higher peripheral speed of the front roller pair 13 (by a factor of for example 25) the major stretching of the sliver 14, 15 takes place.

At the output side of the front roller pair 13, spinning and twisting is effected of the stretched sliver 14, 15 via a thread guide 16 and the traveler 17 of the ring 18 surrounding the bobbin 20 and carried by the ring rail 19. The bobbin 20 on the spindle 20*a* carries the spun yarn 51.

At this point it may be noted that the diagrammatic drawing does not show that the material leaving the front roller pair 13 can have very different thicknesses, especially the filament 21 will be significantly thinner than the stretched sliver 14 and 15 meeting at the yarn triangle below the roller pair 13.

For the invention it is important that the spinning of the yarn 21 is effected with the addition of an elastomer filament 22. The latter is drawn form a supply 23 and is fed to the front roller pair 13. The feed of the elastomer filament 22 is effected over a roller 13*c* frictionally driven by a roller 13*a* of the front roller pair 13. The roller 13*c* is provided with a peripheral guide groove 24 which serves to feed the filament 22 precisely between the two slivers 14 and 15 in the spinning triangle. The elastomer filament 22 is thus spun together with the sliver 14 and 15 and is entirely enveloped thereby on all sides.

The stretch between the supply 23 and the front roller pair 13 amounts to about 300% and the resulting restoring force which is imparted to the knitting yarn corresponding to about 200% elongation. To the extent that the reference is made herein to an elastomer filament, that can be a Lycra filament directly or a core yarn or a wrapped yarn whose core is a Lycra filament or other elastomer and which can be provided with a cotton or similarly elastomeric sheath of cotton or other elastomer which can be spun around the core. The elastomer filament can contain an endless elastomer thread or can be composed of one.

As has been represented at 30, the yarn 20 from the bobbin is used in a knitting machine to produce shaped hosiery articles 31 of elastic fabric. These articles have an especially soft hand, can correspond to the human body part to which they are to be applied closely in shape and can be drawn on without creasing or folding and will ultimately hug the leg or foot.

I claim:

1. A method of making a garment, comprising the steps of:

(a) forming a knitting yarn by combining a first yarn selected from the group which consists of cotton yarn, wool yarn, a synthetic yarn and blends thereof with a second yarn different from the first yarn and including an elastomer, and spinning the combined first and second yarns in a SiroSpun process with a false twist or spinning twist; and (b) knitting said knitting yarn into an elastic garment shaped to conform to a human body part to be received therein.

2. The method defined in claim 1 wherein the elastic garment is hose, a stocking or a sock.

3. The method defined in claim 2 wherein said elastomer is selected from the group which consists of an elastomer filament and an elastomer filament core.

4. The method defined in claim 3 wherein said elastomer filament core is a core of a core yarn and is wrapped with an elastomer filament spun therearound.

5. An elastic garment shaped to fit a human body part and knitted from a knitting yarn formed by combining a first yarn selected from the group which consists of cotton yarn, wool yarn, a synthetic yarn and blends thereof with a second yarn different from the first yarn and including an elastomer, and spinning the combined first and second yarns in a Sirospun process with a false twist or spinning twist.

6. The garment defined in claim 5 which is hose, a stocking or a sock.

7. The garment defined in claim 6 wherein said elastomer is selected from the group which consists of an elastomer filament and an elastomer filament core.

8. The garment defined in claim 7 wherein said elastomer filament core is a core of a core yarn and is wrapped with an elastomer filament spun therearound.

9. The garment defined in claim 5 made exclusively from said knitting yarn.

10. The use of false twist or spinning twist knitting yarn made by combining a first yarn selected from the group which consists of cotton yarn, wool yarn, a synthetic yarn and blends thereof with a second yarn different from the first yarn and including an elastomer, and spinning the combined first and second yarns in a SiroSpun process, for producing an elastic garment in the form of hose, a stocking or a sock.

* * * * *